US007137173B2

(12) United States Patent
Sipple

(10) Patent No.: US 7,137,173 B2
(45) Date of Patent: Nov. 21, 2006

(54) DEVICE FOR LEADING AND HOLDING ELECTRICAL LINES IN A SWIVEL REGION OF DOORS

(75) Inventor: Horst Sipple, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/813,463

(22) Filed: Mar. 29, 2004

(65) Prior Publication Data

US 2005/0001106 A1 Jan. 6, 2005

Related U.S. Application Data

(63) Continuation of application No. PCT/EP02/10210, filed on Sep. 11, 2002.

(30) Foreign Application Priority Data

Sep. 27, 2001 (DE) ..... 101 47 764

(51) Int. Cl.
*E05D 11/00* (2006.01)
*H01R 39/00* (2006.01)

(52) U.S. Cl. ..... 16/223; 439/31

(58) Field of Classification Search ..... 248/49, 248/289.11; 439/31; 200/61.7
See application file for complete search history.

(56) References Cited

U.S. PATENT DOCUMENTS

| | | | | |
|---|---|---|---|---|
| 3,838,234 | A * | 9/1974 | Peterson | 200/61.7 |
| 3,842,386 | A * | 10/1974 | Suska | 439/31 |
| 3,857,625 | A | 12/1974 | Crane et al. | |
| 4,116,514 | A * | 9/1978 | Lawrence | 439/31 |
| 4,412,711 | A * | 11/1983 | Suska | 439/31 |
| 5,941,619 | A | 8/1999 | Stieben et al. | |
| 5,951,312 | A | 9/1999 | Horng | |

FOREIGN PATENT DOCUMENTS

DE 39 17 201 A1 11/1990

* cited by examiner

*Primary Examiner*—Anita M. King
(74) *Attorney, Agent, or Firm*—Russell W. Warnock; Craig J. Loest

(57) ABSTRACT

A device, which reliably guarantees the protection of electric cables that are located in the pivoting region of doors against cable damage or the splitting of an insulating layer includes a device for guiding and fixing electric cables in the pivoting region of doors. The device has first and second tubular sections, each having a sleeve region that is bent at a right angle and a substantially cylindrical cross-section. Both sleeve regions are interconnected such that they can rotate in relation to one another.

6 Claims, 2 Drawing Sheets

DEVICE FOR LEADING AND HOLDING ELECTRICAL LINES IN A SWIVEL REGION OF DOORS

CROSS-REFERENCE TO RELATED APPLICATION

This application is a continuation, under 35 U.S.C. § 120, of copending international application No. PCT/EP02/10210, filed Sep. 11, 2002, which designated the United States; this application also claims the priority, under 35 U.S.C. § 119, of German patent application No. 101 47 764.3, filed Sep. 27, 2001; the prior applications are herewith incorporated by reference in their entirety.

BACKGROUND OF THE INVENTION

Field of the Invention

The invention relates to a device for leading and holding electrical lines in the swivel region of doors.

German Published, Non-Prosecuted Patent Application DE 39 17 201 describes a device for leading and holding electrical lines in the swivel region of doors and the like, particularly, folding doors of dishwashing machines, by an insulating retainer in which the lines are placed. This device has two half-shells that are joined together into which the cable harnesses or cable straps are placed and held there by friction. To protect the cable portion that is exposed to bending from breakage or damage, a fish plate that expands in flat fashion is disposed at each of the half-shell regions, which provides for an optimally small bending radius and protects the insulation of the electrical lines.

The problem of long-term bending loads or alternating bending loads on electrical lines, which may lead to a cable break or material degradation of the insulating layer, is managed, at least for a longer period, by the device according to German Published, Non-Prosecuted Patent Application DE 39 17 201. However, notwithstanding the ability to achieve a certain protection for the electrical lines by the device according to this reference, a significant residual risk remains that electrical lines that are exposed to a regular alternating load will sustain damage.

SUMMARY OF THE INVENTION

It is accordingly an object of the invention to provide a device for leading and holding electrical lines in the swivel region of doors that overcomes the hereinafore-mentioned disadvantages of the heretofore-known devices of this general type and that also guarantees reliable protection against breakage of the cable or the insulation layer in electrical lines that are disposed in the swivel region of doors.

With the foregoing and other objects in view, there is provided, in accordance with the invention, a device for leading and holding electrical lines in a swivel region of doors, including first and second tubular portions each having a respective sleeve region with a cylindrical cross-section and shaped in the form of a crank, the sleeve regions being joined together to rotate against one another.

With the objects of the invention in view, there is also provided a device for leading and holding electrical lines in a swivel region of doors, including first and second tubular portions each having a respective sleeve region with a cylindrical cross-section and shaped in the form of a crank, the sleeve regions being joined together rotatably and rotating with respect to one another.

In the inventive device for leading and holding electrical lines in the swivel region of doors, first and second tubular portions are provided with a cranked sleeve region with a substantially cylindrical cross-section. The two sleeve regions are joined together such that each is rotatable against the other.

The advantage of the inventive device is that the electrical lines that are led therethrough are not exposed to any bending load or alternating bending load; rather, they are subjected only to a torsion load over a defined longitudinal section of the electrical lines. Such torsion load has the advantage that it exerts no pulling and pushing stress on the smallest line portions, which could produce microtears that could lead to the total loss of the electrical lines given permanent loading.

In accordance with another feature of the invention, the sleeve region of the second portion is inserted into the sleeve region of the first portion so that the sleeve region of the first portion surrounds that of the second portion, forming a joint like a plain bearing.

In accordance with a further feature of the invention, it is particularly advantageous to install the device such that the axis of rotation running through the sleeve regions of the inventive device coincides with the pivot axis formed by the doors.

In accordance with an added feature of the invention, to avoid sharp edges or projections that could promote damage to the electrical lines, a step is provided within the interior of the sleeve region of the first portion, by which step the lead-through region for the electrical lines is kept substantially free of changes in diameter.

In accordance with an additional feature of the invention, there are provided fastening elements, advantageously, at one or both portions of the inventive device, which allow fastening to household appliances such as dishwashers, washing machines, stoves, or the like.

In accordance with yet another feature of the invention, the first and second portions are household appliance door swivel devices for fastening in a household appliance, in particular, dishwashers or washing machines.

In accordance with yet a further feature of the invention, the first and second portions are shell-shaped components.

For assembly and furnishing purposes, the inventive device is, advantageously, produced from a thermoplastic and formed from individual shells along a suitable dividing line so that at least a substantial part of the inventive device is divisible and the furnishing of electrical lines can take place without a problem.

The individual shells of the inventive device are joined by an integral hinge such that the excess film region does not represent an obstacle to the serviceability of the joint region of the two sleeve regions, which is in the form of a plain bearing.

For securing the position of the two sleeve regions, the regions are provided with elements that prevent an axial shifting of the sleeve regions. For example, such securing can be realized by a semicircular bead and collar configuration, the bead and collar being disposed on the first and second sleeve regions, respectively.

In accordance with yet an added feature of the invention, there are provided elements preventing axial shifting of the sleeve region of the first portion disposed at the sleeve region of the second portion.

In accordance with yet an additional feature of the invention, there is provided at least one axial stopping element disposed at the sleeve region of the second portion and preventing an axial shift of the sleeve region of the first portion.

In accordance with a concomitant feature of the invention, there are provided elements preventing axial shifting of the sleeve region of the second portion disposed at the sleeve region of the first portion.

Other features that are considered as characteristic for the invention are set forth in the appended claims.

Although the invention is illustrated and described herein as embodied in a device for leading and holding electrical lines in the swivel region of doors, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENT

Figure 1:
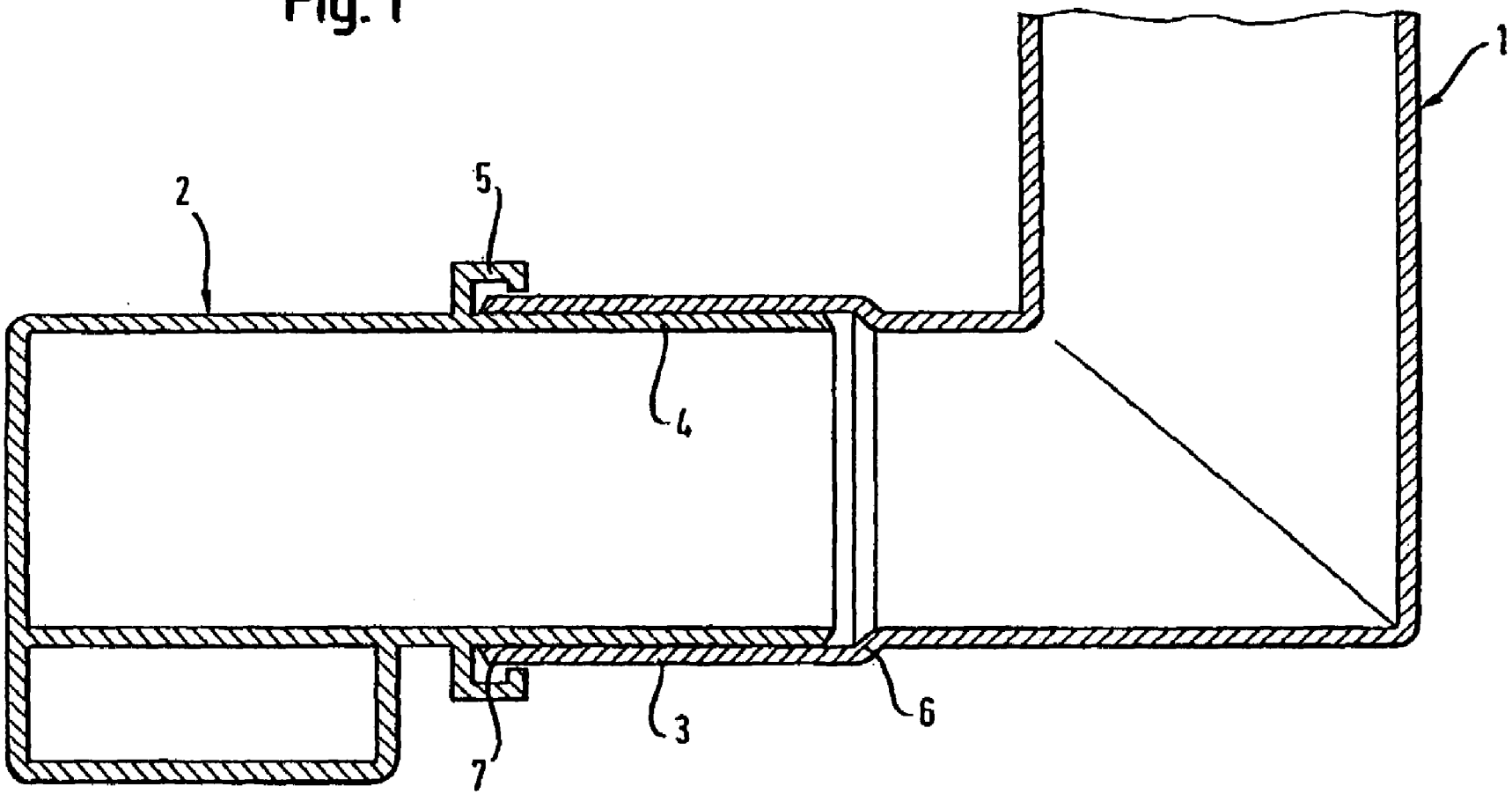
FIG. 1 is a fragmentary, cross-sectional view a device according to the invention for leading and holding electrical lines in the swivel region of doors.

Referring now to the figures of the drawings in detail and first, particularly to FIG. 1 thereof, there is shown a first tubular portion 1 with a sleeve region 3 having a substantially cylindrical cross-section that is cranked upward, whereas the second tubular portion 2, which has a sleeve region 4 with a substantially cylindrical cross-section that is cranked downward, is inserted into the sleeve region 3 of the first portion 1. Stop elements 5 are provided at the second portion 2 to prevent further insertion of the second portion 2 into the sleeve region 3 of the first portion 1 so that, when the sleeve region 4 is inserted into the sleeve region 3, the tongue-shaped end 7 of the sleeve region 3 penetrates the stop element 5 of the sleeve region 4 so that the two portions 1 and 2 are joined by friction in a substantially permanent fashion. To make the joint between the first and second portions 1, 2 still more stable, for instance, in household appliances such as dishwashers that are subject to their own motion, it is expedient to dispose lock noses at the tongue-shaped ends 7 of the sleeve 3, which, in connection with corresponding stop elements 5, produce a joint that is positive as well as non-positive and, thus, prevent the joint between the first and second portions 1, 2 from coming undone of its own accord. The inventive device is, advantageously, installed such that the axis of rotation running through the sleeve regions 3, 4 of the inventive device coincides with the swivel axis formed by the doors.

To avoid sharp edges or projections that could promote damage to the electrical lines, a step 6 is provided within the interior of the sleeve region 3 of the first portion 1, by which step 6 the lead-through region for the electrical lines is kept substantially free of changes in diameter.

Figure 2:
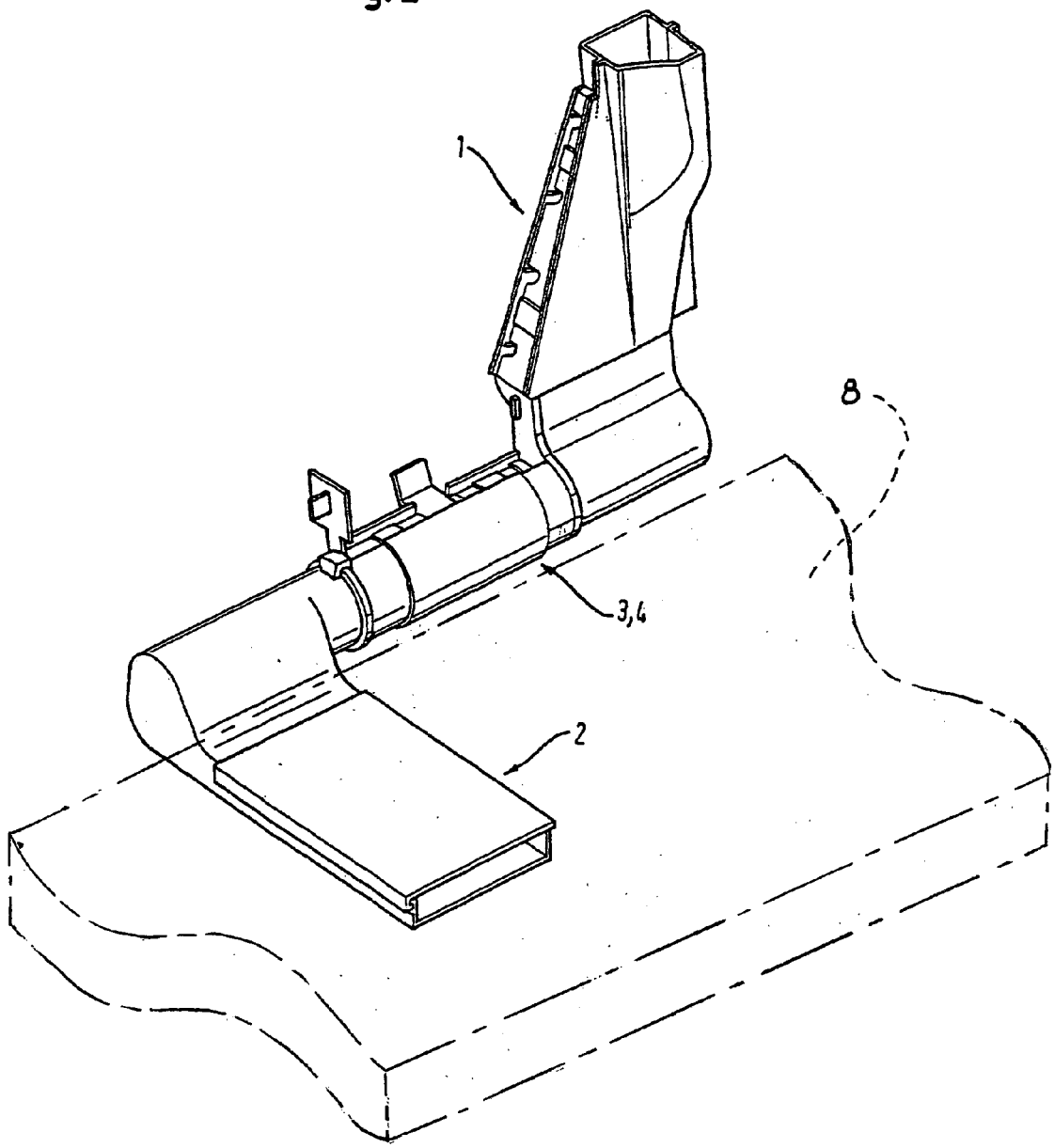
FIG. 2 is a perspective view of the device of FIG. 1.

An illustrative door that is representative of the doors on which the inventive device may be deployed is shown in broken lines in FIG. 2 and is denominated with the reference numeral 8.

FIG. 2 is a perspective representation of the inventive device with a second portion 2 that is configured for cable straps, which run through the central sleeve region and exit the inventive device in individualized form.

I claim:

1. A device for leading and holding electrical lines in a swivel region of doors, the swivel region of a door being a location at which a door pivots about a pivot axis relative to a door frame, the device comprising:

first and second tubular portions each having a respective sleeve region shaped in the form of a crank, said sleeve regions being joined together rotatably and rotating with respect to one another, said first tubular portion being securable to a door and said second tubular portion being securable to a door frame on which the door is pivotally mounted, said first and second portions having a lead-through region, the lead-through regions of said first and second portions together providing a passage through which at least one electrical line can be passed for extending the at least one electrical line to and between the door and the door frame, said sleeve region of said second portion having an interior with a substantially constant diameter and said sleeve region of said first portion having a step within said interior of said first portion keeping said lead-through region through said first and second portions substantially free of diameter changes; and elements preventing axial shifting of said sleeve region of said second portion disposed at said sleeve region of said first portion and wherein said sleeve region of said first portion has one extent forming an open end of said first portion and another extent extending from said one extent, said one extent of said sleeve region of said first portion having an inner diameter relatively larger than the inner diameter of said other extent of said sleeve region of said first portion, said one extent of said sleeve region of said first portion receiving said sleeve region of said second portion inserted therein so that said one extent of said sleeve region of said first portion surrounds said sleeve region of said second portion, the inner diameter of said other extent of said sleeve region of said first portion being substantially the same as the inner diameter of said sleeve region of said second portion, and said step of said sleeve region of said first portion forming a transition from said one extent of said sleeve region of said first portion to said other extent of said sleeve region of said first portion such that the extent of the lead-through region formed by said other extent of said sleeve region of said first portion and said sleeve region of said second portion is substantially free of diameter changes.

2. The device according to claim 1, where in said sleeve region of said first portion surrounds a substantial part of said sleeve region of said second portion.

3. The device according to claim 1, wherein:

said sleeve regions define a rotation axis coinciding with the pivot axis of the respective door on which the device is mounted.

4. The device according to claim 1, further comprising at least one axial stopping element disposed at said sleeve region of said second portion and preventing an axial shift of said sleeve region of said first portion.

5. The device according to claim 1, wherein said first portion is securable to a door of a household appliance and said second portion is securable to a door frame of a household appliance.

6. The device according to claim 5, wherein said first portion is securable to a door of a selected one of the group consisting of dishwashers and washing machines and, second portion is securable to a door frame of the selected one of the group consisting of dishwashers and washing machines.

* * * * *